United States Patent [19]

Boysen

[11] 3,968,463

[45] July 6, 1976

[54] COAXIAL CABLE WITH IMPROVED PROPERTIES

[75] Inventor: Robert L. Boysen, Lebanon, N.J.

[73] Assignee: Union Carbide Corporation, New York, N.Y.

[22] Filed: July 24, 1974

[21] Appl. No.: 491,345

Related U.S. Application Data

[63] Continuation-in-part of Ser. No. 386,749, Aug. 8, 1973, abandoned.

[52] U.S. Cl. ..... 333/96; 29/600; 174/28; 174/110 F; 260/2.5 E; 260/2.5 HA; 264/45.9; 264/46.1; 264/46.2; 264/174

[51] Int. Cl.[2] ..... H01P 3/06

[58] Field of Search ..... 260/2.5 E; 264/45.9, 264/46.1; 333/96; 174/110, 28 F

[56] References Cited

UNITED STATES PATENTS

| | | | |
|---|---|---|---|
| 2,818,905 | 1/1958 | Simmonds et al. | 264/45.9 |
| 2,948,020 | 8/1960 | D'Ascoli | 264/45.9 |
| 2,960,482 | 11/1960 | Henning | 260/2.5 E |
| 3,068,532 | 12/1962 | Higgens | 264/45.9 |
| 3,072,972 | 1/1963 | Yokese et al. | 260/2.5 E |
| 3,254,139 | 5/1966 | Anderson et al. | 260/2.5 E |
| 3,404,104 | 10/1968 | Hill et al. | 260/2.5 E |
| 3,516,859 | 6/1970 | Gerland et al. | 264/45.9 |

*Primary Examiner*—Richard B. Turer
*Attorney, Agent, or Firm*—Gerald R. O'Brien

[57] ABSTRACT

A coaxial cable having improved mechanical and electrical properties comprising an inner conductor; an outer inert gas blown cellular ethylene or propylene polymer dielectric layer having in unexpanded form a density of about 0.86 to 0.96 grams per cubic centimeter, a melt index of about 0.05 to 10 decigrams per minute and an expanded density up to 0.6 grams per cubic centimeter, said core member having a dissipation factor value of $\leq$ 250 microradians at an electrical transmission frequency range of from 50 to 300 mega Hertz; and an outer coaxial conductor.

5 Claims, 2 Drawing Figures

COAXIAL CABLE WITH IMPROVED PROPERTIES

This is a continuation-in-part of our earlier application Ser. No. 386,749, filed Aug. 8, 1973, now abandoned.

BACKGROUND OF THE INVENTION

1. Field of the Invention

This invention relates to coaxial cable having, as a dielectric coating on the core conductor, an extruded cellular ethylene or propylene polymer based composition.

2. Description of the Prior Art

Coaxial cables usually comprise a core conductor member coated with a dielectric, with an outer conductor member superimposed on the dielectric.

It is known that the attenuation properties of a coaxial cable can be determined by the following equation:

$$A = 4.35\,(R_t/Z_o) + 2.78\,[(pf)\,F\,\sqrt{E}]$$

wherein $$R_t 32\ 0.1^*(1/d + 1/D)\ \sqrt{F}$$

(for solid copper conductor)

$$Z_o = \frac{138}{\sqrt{E}} \log_{10} \frac{D}{d}$$

$R_t$ = resistance in ohms (*0.1 is constant for a solid copper inner conductor)

$A$ = attenuation in db per 100 foot of cable $Z_o$ = characteristic impedance of cable in ohms $pf$ = power factor of the dielectric in radians $F$ = test frequency in mega Hertz $E$ = dielectric constant of the dielectric core $D$ = outer diameter of the dielectric layer in inches $d$ = outer diameter of the inner conductor in inches It can be seen from this equation that $Z_o$ and $R_t$ are determined by D, d and F, all of which are fixed by the cable size and the test frequency and that the dissipation factor and dielectric constant further determine the attenuation of the cable.

The dielectric materials employed heretofore in coaxial cables were usually compositions based on ethylene polymers or on polystyrene. The dielectrics formed from the ethylene polymers, however, usually had poor electrical properties, particularly poor attenuation properties. As a result, coaxial cable made with ethylene polymer based dielectric compositions had disadvantages in that they had dissipation factors (pf) in the range of 290–500 microradians at an electrical transmission frequency range of 50–300 mega Hertz, and a dielectric constant in the range of 1.40 to 1.60. Such cables, moreover, may have to be dried, prior to the swaging on the outer conductor of the cable, to remove any water therefrom which may have been generated in the cable during the decomposition of the chemical blowing agents used to make the cellular dielectric layers used in such cables. Swaging is the process whereby the cable is passed through one or more dies to reduce the outside diameter of the outer conductor.

The dielectrics formed from polystyrene, however, while they had relatively good electrical properties, i.e. a dielectric constant of 1.1 to 1.2 and a dissipation factor in the range of 180–350 microradians, had relatively poor physical properties. As a result, coaxial cables heretofore made with polystyrene had disadvantages in that they had higher scrap rates in production and required special handling due to the poor physical properties of the surfaces of such dielectric compositions.

Prior to the present invention, therefore, it has not been readily possible to provide dielectric materials for use in coaxial cables which reproducibly provide the cable with both good mechanical properties and good electrical properties.

SUMMARY OF THE INVENTION

Coaxial cable is provided having good mechanical and electrical properties with a dielectric layer formed from extruded expanded ethylene or propylene polymer.

An object of the present invention is to provide coaxial cable having a combination of good mechanical and electrical properties.

Another object of the present invention is to provide coaxial cable products which comprise expanded ethylene or propylene polymer as a dielectric and which has an electrical dissipation factor of $\leq 250$ preferably $<150$ microradians in an electrical transmission frequency range of 50–300 mega Hertz.

A further object of the present invention is to provide a process whereby ethylene or propylene polymer may be extruded onto the core conductor of coaxial cable so as to provide a dielectric layer having good mechanical and electrical properties.

A still further object of the present invention is to provide a process for making coaxial cable having good mechanical and electrical properties, without the need for drying the cable prior to the swaging thereof.

These and other objects are achieved by rendering the ethylene or propylene polymer layer cellular, during the extrusion thereof on the core conductor, as described below in more detail, with an inert gas as a blowing agent.

DESCRIPTION OF THE PREFERRED EMBODIMENT

Figure 1:
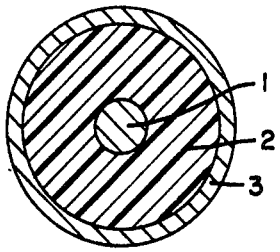
FIG. 1 shows a cross-section of coaxial cable of the present invention.

The present applicant has found that coaxial cable having good mechanical and electric properties can be prepared with an ethylene or propylene polymer based composition as a dielectric layer between the inner and the outer conductors of the cable if the insulating dielectric layer is based on a cellular or expanded ethylene or propylene polymer based composition which is applied to the core conductor in a gas injection extrusion process using an inert gas as the blowing agent for the cellular composition.

The dielectric layer used in the present invention is formed from an expandable composition which comprises about a. 98.00 to 99.99 weight percent of ethylene or propylene polymer, and b. 0.01 to 1.00 weight percent of each of a nucleating agent and an antioxident.

ETHYLENE OR PROPYLENE POLYMER

The ethylene or propylene polymers which are used in the compositions of the present invention are solid (at 25°C.) materials which are preferably homopolymers of ethylene or propylene or blends thereof. The polymers may also be copolymers which contain about >50 to <100 weight percent of ethylene or propylene and about >0 to <50 weight percent of one or more nonpolar organic compounds which are interpolymerizable with ethylene or propylene. These compounds shich are interpolymerizable with ethylene or propylene are preferably those which contain polymerizable unsaturation, such as is present in compounds containing an ethylene linkage, >C=C<. These interpolymerizable non-polar compounds may be hydrocarbon compounds such as propylene, butene-1, pentene-1, isoprene, butadiene, bicycloheptene, bicycloheptadiene, and styrene.

Polar compounds which contain a polymerizable ethylene linkage may also be used in small amounts, i.e., ≤ 3 weight percent, and preferably ≤ 1 weight percent, in the ethylene or propylene polymer, provided that the addition of such polar monomers to the ethylene or propylene polymer does not detract from the desired electrical properties of the cable made therewith, for a given application. Such polar compounds would include vinyl acetate and ethyl acrylate.

The ethylene polymers may be used individually, or in combinations thereof.

The ethylene or propylene polymers have a density (ASTM 1505 test procedure with conditioning as in ASTM D-1248-72) of about 0.86 to 0.96 and a melt index (ASTM D-1238 at 44 psi test pressure) of about 0.05 to 10 decigrams per minute.

NUCLEATING AGENT

The nucleating agents which are used in the compositions of the present invention are materials which provide fine particle sized nucleating sites in the ethylene or propylene base polymer during the expansion or blowing thereof, as described below.

The particle size of the nucleating agents should be of the order of about 0.1 to 25 microns.

The nucleating agents may be of two types. One type is added to the base polymer as a solid material which, itself, is of the desired particle size, i.e., 0.1 to 25 microns. Such materials would include polytetrafluoroethylene.

The other type of nucleating agent is a material from which a fine particle sized nucleating site material is formed, in situ, in the base polymer. Such nucleating agents would include thermally decomposible organic blowing agents which have a decomposition temperature of the order of about 130° to 275°C. Such blowing agents, and their decomposition temperatures, would include azodicarbonamide (190°–230°C.), p,p'-oxybis(benzene sulphonyl hydrazide) (150°–160°C.), trihydrazino-sym-triazine (265°–290°C.), and p-toluene sulfonyl semi-carbazide (213°–225°C.).

The nucleating agents may be used individually or in combinations thereof.

The nucleating agents should be dispersed as uniformly as possible throughout the mass of the base polymer. They should also be chemically inert towards and insoluble in the base polymer and any other components of the expandable composition of the present invention.

EXPANSION AGENT

During the extrusion of the expandable compositions, as will be described below, an expansion agent is added, as a gas, to the expandable compositions. Such expansion agents should be chemically inert towards, and preferably soluble in, the base polymer, and any of the other components of the expandable composition. The expansion agents are also not thermally decomposable under the intended operating conditions and would thus include inert gases, such as nitrogen, argon, helium, neon, and carbon dioxide.

Other expansion agents may be used if, under the prescribed operating conditions, they are inert to the base polymer and the other components of the expandable composition, they are non-polar materials, and they are gaseous at the point of injection into the ethylene polymer composition, i.e. interface between the composition and the expansion agent. Thus such expansion agents would include the Freon type blowing agents.

The term "non-polar" means, with respect to the chemicals that are to be used in the present invention, that such chemicals do not significantly increase the dissipation factor of the dielectric.

The expansion agents are used in such quantities as to provide the expanded composition, in expanded extruded form, with a density of about 0.30 to 0.60 grams/cc. The amount of expanding agent needed for this purpose will vary, depending on various factors, such as the desired density and thickness of the expanded composition, the density of the base polymer, the selection and particle size of the nucleating agent, and the speed with which the core conductor is to be coated with the expanded composition. An equation which may be used to determine the amount, in terms of volume (at standard temperature and pressure, STP) of the expansion agent which is to be used in the process of the present invention is the following:

$$W = (A)\,(LS)\left(\frac{P_b - P_l}{P_b}\right) \qquad \text{II}$$

wherein

W = ft³/hour volume

LS = line speed at which the core conductor is being coated in feet/hour.

$P_b$ = density of the base polymer in gr/cc.

$P_l$ = density of the expanded ethylene polymer (dielectric coating) in gr/cc.

A = cross-sectional area of the dielectric in ft² and calculated by $$A = \frac{\pi\,(D^2 - d^2)}{576} \qquad \text{III}$$

wherein

D = outside diameter of the dielectric layer in inches d = outside diameter of the inner conductor in inches D-d=the thickness of the dielectric layer in inches.

IV

ADJUVANTS

In addition to the base polymer, the nucleating agent, and the expansion agent the expandable compositions advantageously include about 0.01 to 1.0 percent by weight of a suitable high temperature anti-oxidant.

These antioxidants are non-polar compounds, and are preferably sterically hindered phenols. Such compounds would include 1,3,5-trimethyl-2,4,6-tris(3,5-ditertiary butyl-4-hydroxy benzyl)benzene; 1,3,5-tris(3,5-ditertiary butyl-4-hydroxy benzyl)-5-triazine-2,4,6-(1H,3 H, 5H)trione; and tetrakis-[methylene-3-(3',5'-di-t-butyl-4'-hydroxy phenyl)-propionate]methane.

EXPANDABLE COMPOSITION

The expandable compositions which are used in the process of the present invention would comprise, therefore, except for the expansion agent component, about:

| Component | Amount (parts by weight) |
|---|---|
| ethylene or propylene base polymer | 99.98 to 98.00 |
| nucleating agent | 0.01 to 1.00 |
| antioxidant | 0.01 to 1.00 |

COAXIAL CABLE

As shown in cross-section in FIG. 1 of the drawings, the coaxial cable of the present invention comprises a continuous core conductor member 1 which is continuously covered by, in expanded form, an expandable composition 2 of the present invention. Expanded composition 2 is a dielectric layer which is, in turn, encased by a continuous outer conductor 3. Optionally, outer conductor 3 may also be encased with a continuous outer insulating jacket, which is not shown. Such an outer jacket may be formed of polyvinyl chloride, polyethylene, or other suitable insulating materials known to the art.

As compared with prior art coaxial cables, wherein layer 2 was made with an ethylene polymer based dielectric material, and which has attenuation values, as measured by dissipation factors, of at least 290 micro radians at an electrical transmission frequency range of 50–300 megaHertz at 0.3–0.6 gr/cc density, the coaxial cables of the present invention have dissipation factors, under such conditions, of $\leq$ 250 microradians. These cables also retain the good mechanical properties provided by the base polymer.

The coaxial cables of the present invention may be used as CATV cable, submarine coaxial cable and telephone transmission coaxial cable, or other coaxial cables which are used for communications applications.

Core conductor 1 is usually a single electrical conductor which has a diameter of about 0.001 to 0.500 inch. It may also comprise a plurality of single electrical conductors, stranded together, each of which has a diameter of about 0.1 to 50 mils. Core conductor 1 is made of an electricity conducting metal or alloy such as copper, aluminum, or copper clad aluminum.

Dielectric layer 2 has a density of about 0.30 to 0.60 grams per cubic centimeter. It has a thickness, i.e. the distance from the outer surface of core conductor 1, of about 0.004 to 1.90 inches. The thickness of layer 2 is preferably substantially uniform, as measured from any point on the outer surface of core conductor 1. The cellular base polymer composition which forms dielectric layer 2, has cells therein (which form around the nucleating agent dispersed therein) which are of the order of 2 to 100 microns in average diameter.

The combination of core conductor 1 with dlelectric layer 2 extruded thereon, is usually referred to, in the art, as the core member of the coaxial cable.

Outer conductor 3 is a relatively thin sheet of an electrical conductor which has a thickness of about 1 to 100 mils. Outer conductor 3 is made of an electricity conducting metal or alloy such as copper or aluminum.

Outer conductor 3 may be made of an electricity conducting material which is the same as, or which is different from, that used in core conductor 1.

Where a specific cable impedance is desired the relative thicknesses of core conductor 1 and dielectric layer 2 must be such that, as noted above with respect to Equation I:

$$Z_o = \frac{138}{\sqrt{E}} \log_{10} \frac{D}{d}$$

wherein $Z_o$ = impedance in ohms
E = dielectric constant at the dielectric layer
D = outer diameter of the dielectric layer in inches
d = outer diameter of the inner conductor in inches

PROCESSING PRIOR TO EXTRUSION

The components of the expandable compositions of the present invention, with the exception of the expansion agent, are usually blended together, prior to their introduction into the extrusion device from which they are to be extruded onto the core conductor. The base polymer, the nucleating agent as well as any other desired constituents, may be blended together by any of the techniques used in the art to blend and compound thermoplastics to homogeneous masses. For instance, the components may be fluxed on a variety of apparatus including multi-roll mills, screw mills, compounding extruders and Banbury mixers, or dissolved in mutual or compatible solvents.

When all the solid components of the expandable composition are available in the form of a powder, or as small particles, the compositions are most conveniently prepared by first making a blend of the components, say in a Banbury mixer or a continuous extruder, and then masticating this blend on a heated mill, for instance, a two-roll mill, and the milling continued until an intimate mixture of the components is obtained. Alternatively, a master batch containing the nucleating agent and, if desired, some or all of the other components may be added to the mass of polymer. Where the base polymer is not available in powder form, the compositions may be made by introducing the polymer to the mill, masticating it until it forms a band around one roll, after which a blend of the remaining components is added and the milling continued until an intimate mixture is obtained. The rolls are preferably maintained at a temperature within the range 80°C to 150°C. The composition in the form of a sheet is removed from the mill and then brought into a form, typically dice-like pieces, suitable for subsequent processing.

PROCESSING IN AND THROUGH EXTRUDER

Figure 2:
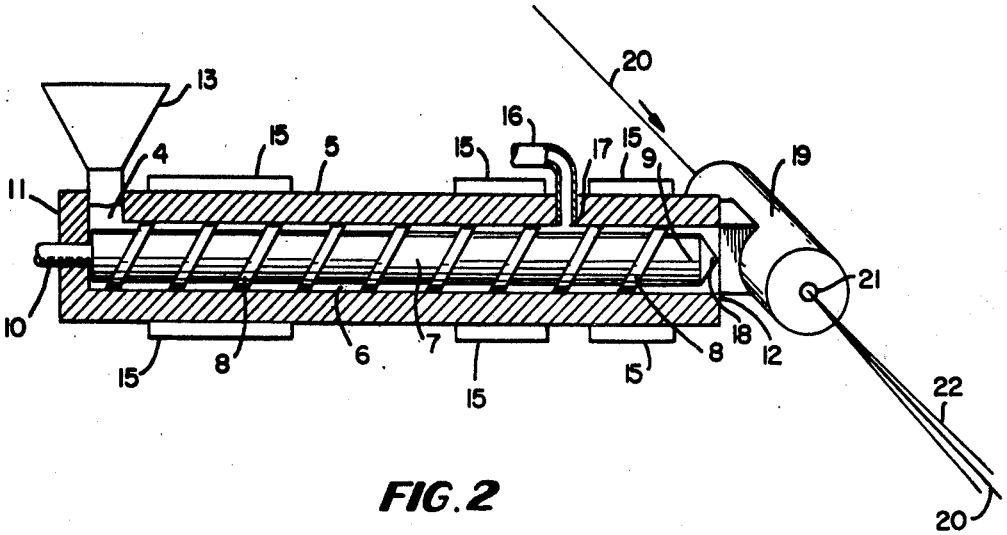
FIG. 2 shows a cross-section of an extrusion apparatus which may be used in the fabrication of coaxial cable with the process of the present invention.

After the various components of the expandable compositions of the present invention are uniformly admixed and blended together, they are further processed, in accordance with the process of the present invention, in apparatus as shown in partial cross-section in FIG. 2. The apparatus shown in FIG. 2 comprises an extrusion device 4 which has a housing 5. Within housing 5 there is a cylindrical well 6 which extends through most of the length of housing 5. A single cylindrical screw extrusion component device 7 is housed within well 6. Extruder component 7 has a series of flight members 8 which are evenly spaced along the length of rotatable shaft 9 of extruder 7. Extruder component 7 is turned in well 6 by means of power shaft 10 which is connected to a power source, which is not shown. Extruder component 7 may be a single or multistage screw. Housing 5 also has an input end 11 at which expandable composition is fed into extrusion device 4, and an exhaust end 12 at which the expanable composition is extruded from extrusion device 4.

The expandable composition of the present invention is fed into the extrusion chamber or well 6 of extrusion device 4 through hopper means 13, which funnels such composition into well 6 through an orifice 14 which is located towards the input end 11 of housing 5.

Heating means 15 are provided for heating the expandable composition, when it is within extrusion device 4, to a temperature of about 125° to 250°C. Housing 5 is made of a heat conducting material such as metal, such as iron or steel.

Shaft 9 of extruder component 7 has a ratio of length to diameter of at least 16:1 and preferably of ≥ 20.1. Extruder component 7, with flight members 8, is designed to move the expandable composition through well 6 from input end 11 of extruder device 4 towards exhaust end 12 thereof, at a rate of feed of about 0.5 to 15 pounds per hour per revolution (of extruder component 7) per minute under the temperature and pressure conditions prevailing within well 6.

Extrusion device 4 is used in the processing of the expandable composition in order to, first, melt the composition so that it can be extruded into the desired shape, and second, then extrude it through a die which will determine the shape that the extrudate is to have. While the expandable composition is being processed in the extruder it passes through three zones, each of which are about 4:6:10 screw diameters of the length of shaft 9 of extruder component 7.

In some extruders the three zones, first, second, and third, may also have a length ratio to each other of ¼:¼:½, or other ratios.

The first zone is termed a feed zone in which the base polymer composition, usually in pellet form, is moved from the inlet end of the extruder device towards its outlet end by the rotating flights on the rotating shaft of the screw device, while being heated to its melting temperature.

The second zone is a transition zone in which the pellets are further advanced towards the outlet end of the extruder device by the screw device, while being compacted to exhaust any entrained air. The entrained air is exhausted out the inlet hopper.

The third zone is a metering zone in which the melting of the base polymer composition is completed, if not previously accomplished, and the melted composition is metered proportionally per each revolution of the screw device. The heating in the transition zone is such that by the time the base polymer composition has reached the end of the transition zone, 90–100% of the expandable composition has been rendered molten.

The design of extruder 7, with flight members 8, is such that, as the expandable composition is moved from inlet end 11 towards exhaust end 12 of well 6, the pressure within well 6 builds up. Maximum pressure of about 600 to 10,000 psig is attained near beginning of the metering zone, and then the pressure tapers off to about 600 to 7,000 psig at the exhaust end 12 of well 6, in the absence of the use of the inert gas as described below.

The level of the pressure within the well of the extruder, at its maximum, and when it levels off, will vary depending on the intended diameter of the dielectric coating. Generally, for example, with ethylene polymer composition used as CATV dielectrics in outer diameters ranging from 5/16 to 1⅞ inches, the maximum pressure levels will range from 600 to 3,000 psig, with tapering off to about 600 to 2,000 psig. Where a small diameter coaxial cable is to be made, wherein the dielectric layer will have a diameter of about 0.004 inches, the maximum pressures will range up to about 10,000 psig, with tapering off at up to 7,000 psig.

In accordance with the process of the present invention, an inert gas is supplied to well 6 through inlet pipe 16 which is inserted in an orifice 17 which is provided in housing 5. The location of inlet pipe 16 is critical to the successful operation of the process of the present invention. Inlet pipe 16 must have access into well 6 at a point therein where 70 to 100% of the base polymer composition therein is molten, so that the molten polymer can form a seal to prevent the rearward movement of this inert gas in well 6. This point, therefore, is within the metering zone of well 6. The location of inlet pipe 16 must also be such that it be located at a distance from exhaust end 12 of well 6 which is no more than 1/10 to ½ the length of well 6.

The inert gas is supplied continuously to well 6 from a source, not shown, which is designed to supply the inert gas at a pressure sufficient to allow for the entry of the needed amount of inert gas into the pressurized system in the extruder. The amount of inert gas used is determined by a number of factors, as will be discussed further below, and is of the order of about 0.3 to 10.0 cubic feet per hour (at STP).

By the time the expandable composition reaches exhaust end 12 of well 6 it it completely molten. It is extruded from well 6 into die head 19. An electrical conductor 20, which is to be coated with the expanded extruded compositions of the present invention is fed into die head 19 at speeds of the order of about 20 to 5,000 feet per minute. Conductor 20 may vary in diameter from about 0.010 to 0.400 inches. As conductor 20 passes through die head 19 a uniform coating of the extrudate from well 6 is circumferentially applied to the conductor 20. The initial thickness of the extruded coating is determined by the orifice in die 21 which is located in the side of die head 19, and through which die 21 the coated conductor 20 emerges from die head 19. As the thus coated conductor 20 travels away from die 21, the coating thereon, which contains nucleating agent and pressurized inert gas, begins to expand because the coated wire is not in an ambient temperature and pressure environment, of about 25°–30°C. and 15 psia (pounds per square inch absolute). The expanding coating 22 on conductor 20 is cone shaped for a distance of about 0.20 to 5 feet from die 21, but by then the coating will have reached its maximum expanded thickness and the coating will be uniformly thick, in its expanded form.

While it is in die head 19 the expandable coating is maintained at a pressure of above about 200 psig and at a temperature of about 120° to 250°C.

The thickness of the expanded coating will depend on a number of factors, such as the speed of the conductor 20 through die head 19, the size of the orifice in die 21, the thickness of conductor 20, the rheological properties of the expandable composition and the pressure of the inert gas fed through pipe 16.

The outer conductor is then applied to the core member of the cable by standard procedures. Since no water is formed, however, during the application and expansion of the dielectric layer in the process of the present invention, drying of the cable, prior to the swaging of the cable, is not necessary. Swaging of the cable is employed to reduce the outside diameter of the outer conductor to remove entrapped air from the cable.

The attenuation properties of the cable are measured after the swaging operation. In this test procedure about 1000 to 2000 feet of the cable is tested. The test sample is tested by measuring the attenuation in the cable at various electrical transmission frequencies of i.e., 50, 100, 150, 200, 211, 250 and 300 mega Hertz, at a dielectric constant in the range of 1.40 to 1.60. Then the dissipation factor (pf) is calculated for each of the above noted attenuation values using the following equation:

$$\text{IV } (pf) = \frac{(AH - 4.35\ R/Z_o)}{2.78\ F\ \sqrt{E}}$$

wherein

AH = attenuation in db per 100 foot of sample $$R_t = 0.1\left(\frac{1}{d} + \frac{1}{D}\right)\sqrt{F}$$

(for solid copper inner conductor)

F = test frequency in mega Hertz

E = dielectric constant of the dielectric core $Z_o$ = characteristic impedance in ohms d = outer diameter of the inner conductor in inches D = outer diameter of the electric layer in inches The following examples are merely illustrative of the present invention and are not intended as a limitation upon the scope thereof.

EXAMPLE 1

A 0.412 inch in diameter CATV cable was made by the process of the present invention employing an 0.078 inch O.D. (outer diameter) copper wire as the inner conductor and an 0.025 inch thick aluminum conductor as the outer conductor. The dielectric layer was formed from a composition containing 99.85 weight percent of an ethylene homopolymer having a density of 0.921 grs/cc and a melt index of 0.1 dg/minute, 0.1 weight percent of azodicarbonamide and 0.05 weight percent of 1,3,5-trimethyl-3,4,6-tris(3,5-di-t-butyl-4-hydroxy benzyl) benzene.

The dielectric composition was processed, as described above, in a 2½ inch diameter single stage screw extruder having a length to diameter ratio of 20:1. Each of the feed zone, transition zone and metering zone length ratios in the extruder were about 4, 6 and 10 diameters respectively. The barrel or housing of the extruder was heated to about 160°C. near the inlet end of the extruder, and to about 180°C. in the vicinity of the inert gas port, and to about 165°C. at the outlet end of the extruder. The extruder screw was operated at a speed of 30 rpm (revolutions per minute) and the pressure in the head of the extruder was 1100 psig. Nitrogen gas was used as the inert gas expansion agent and it was injected into the molten polymer in the extruder under a pressure of 1280 psig. The nitrogen was fed into the extruder at the rate of about 0.4 cubic feet per hour, at a point which was 7.7 (screw) diameters from the outlet end of the extruder. This point was located at a distance from the outlet end of the extruder which was about 37% the length of the well. The ethylene polymer based dielectric composition was molten by the time it reached the nitrogen inlet port.

The molten dielectric composition, with the nitrogen gas dispersed therein was then passed through the die head at a temperature of about 187°C. and at a pressure of about 1100 psig. The dielectric composition was processed in the extruder at a rate of feed of about 1.75 pounds per hour per revolution of the screw per minute.

The inner conductor was preheated to 150°C. and passed through the die head at a rate of 22 feet per minute. A 0.250 inch vinyl resin coating die and a guider tip with an inner diameter of 0.084 inches were used in the die head. The dielectric composition was extruded onto the conductor, and it expanded, outside the die head, to form a cellular composition having a density of 0.53 grams/cc and a uniform cell structure in which the cells had an average diameter within the range of 2.0 to 4.8 mils.

The outer conductor was then applied to the core member prepared above and the resulting construction was swaged to reduce the O.D. of the cable to 0.412 inch. The cable did not have to be dried, to remove moisture therefrom, prior to the swaging operation. About 600 feet of this cable were prepared.

When tested for attenuation values and dissipation factor values the cable had the following properties at the listed electrical transmission frequencies:

| Test Frequency, mega Hertz | Attenuation db/100 ft cable | Dissipation factor, microradians |
|---|---|---|
| 211 | 1.42 | 104 |
| 300 | 1.81 | 198 |

EXAMPLE 2

A 0.750 inch diameter CATV cable was made by the process of the present invention employing an 0.146 inch OD copper wire as the inner conductor and an 0.035 inch thick aluminum conductor as the outer conductor. The dielectric layer was formed from the dielectric composition employed in Example 1.

The dielectric composition was processed, as described above, in a 3½ inch in diameter single stage screw extruder having a length to diameter ratio of 20:1. The lengths of each of the feed zone, transition zone and metering zone in the extruder were as employed in the extruder of Example 1. The extruder was heated to 175°–200°C. so as to heat the dielectric composition to 195°C. while it was molten. The extruder screw was operated at a speed of 40 RPM and the pressure in the head of the extruder was 1300–1500 psig. Nitrogen gas was used as the inert gas expansion agent and it was injected into the molten polymer in the extruder under an injection port pressure of 1375–1560 psig. The nitrogen was fed into the extruder at the rate of about 3.3 $ft^3$/hour, at a point which was 7.7 screw diameters from the outlet end of the extruder. This point was located at a distance from the outlet end of the well of the extruder which was about 37% the length of the well. The polymer based dielectric composition was molten by the time it reached the nitrogen inlet port.

The molten dielectric composition, with the nitrogen gas dispersed therein was then passed through the die head at a temperature of about 195°C. and at a pressure of about 1380 to 1560 psig. The dielectric composition was processed in the extruder at a rate of feed of about 3.6 pounds per hour per revolution of the screw per minute.

The inner conductor was preheated to about 107°C. and passed through the die head at the rate of 40 feet per minute. The die in the die head had an OD of 0.348 inch. The dielectric composition was extruded onto the conductor, and it expanded, outside the die head, to form a cellular composition having a density of 0.38–0.40 grams/cc.

The outer conductor was then applied to the core member prepared above and the resulting construction was swaged to reduce the OD of the cable to 0.750 inch. The cable did not have to be dried, to remove moisture therefrom, prior to the swaging operation. About 2100 feet of this cable were prepared.

When tested for attenuation values and dissipation factor values the cable had the following properties at the listed electrical transmission frequencies:

| Test Frequency mega Hertz | Attenuation, db/100 ft cable | Dissipation factor, microradians |
|---|---|---|
| 211 | 0.79 | 138 |
| 300 | 0.98 | 155 |

EXAMPLE 3

A 0.500 inch diameter CATV cable was made by the process of the present invention employing an 0.097 inch OD copper wire as the inner conductor and a 0.025 inch thick aluminum conductor as the outer conductor. The dielectric layer was formed from the dielectric composition employed in Example 1.

The dielectric composition was processed, as described above, in a 3½ inch in diameter single stage screw extruder having a length to diameter ratio of 21:1. Each of the feed zone, transition zone and metering zone in the extruder were of lengths indicated with respect to the apparatus of Example 1. The extruder was heated to about 205°C. so as to heat the dielectric composition to 205°C. while it was molten. The extruder screw was operated at a speed of 71 RPM. Nitrogen gas was used as the inert gas expansion agent and it was injected into the molten polymer in the extruder under an injection port pressure of about 2950 psig. The nitrogen was fed into the extruder at the rate of about 2.48 $ft^3$/hour, at a point which was 7.7 screw diameters from the outlet end of the extruder. This point was located at a distance from the outlet end of the well of the extruder which was about 37% of the length of the well. The ethylene polymer based dielectric composition was molten by the time it reached the nitrogen inlet port.

The molten dielectric composition, with the nitrogen gas dispersed therein was then passed through the die head at a temperature of about 205°C. The dielectric composition of about 2 pounds per hour per revolution of the screw per minute.

The inner conductor was preheated to about 120°C. and passed through the die head at the rate of 79 feet per minute. The dielectric composition was extruded onto the conductor, and it expanded, outside the die head, to form a cellular composition having a density of 0.45 gr/cc.

The outer conductor was then applied to the core member prepared above and the resulting construction was swaged to reduce the OD of the cable to 0.500 inch. The cable did not have to be dried, to remove moisture therefrom, prior to the swaging operation. Three lengths of this cable were produced, each of which was 2100 feet long.

When tested for attenuation values and dissipation factor values the cable had the following properties at the listed electrical transmission frequencies:

| Test Frequency, mega Hertz | Attenuation, db/100 ft cable | Dissipation factor, microradians |
|---|---|---|
| 50 | 0.555 | 103 |
| 100 | 0.81 | 146 |
| 211 | 1.19 | 115 |
| 250 | 1.30 | 114 |
| 300 | 1.46 | 139 |

The attenuation and dissipation factor values which can be provided in the novel coaxial cables of the present invention are substantially lower, i.e., about 9–22% lower, than those values previously attainable with coaxial cables made with ethylene polymer based dielectric compositions. These attenuation and dissipation factor values which can be obtained in the novel cables of the present invention approximate those attainable using cellular polystyrene dielectric compositions. The coaxial cables of the present invention, however, do not have the poor mechanical properties that are present in cables made with polystyrene based dielectric compositions.

It is also to be noted from a review of the attenuation and dissipation factor values of the coaxial cables made in the examples above, that the coaxial cables of the present invention have dissipation factor values at a test frequency of 211 mega Hertz of $\leq$ 150 microradians, and dissipation factor values at a test frequency of 300 mega Hertz of $\leq$ 200 microradians. These test frequencies represent the mid frequency range used by Channel 13 television station in the United States which range is 209–213 mega Hertz and the highest commercial frequency usually specified (300) in the U.S. for CATV operations, and thus provide an indication that the coaxial cables of the present invention provide relatively low attenuation and dissipation factor values for the more important current commercial applications for coaxial cable.

In making the calculations disclosed above known dielectric constants were used for the expanded base polymer dielectric compositions. These constants vary depending on the density of the expanded cellular base polymer composition employed. There is, however, an empirical relation between the density of the dielectric composition and the dielectric constant. The dielectric constants for the various dielectric compositions employed in the examples above are as follows:

| Example | Density of dielectric composition | Dielectric constant for composition |
|---|---|---|
| 1 | 0.53 | 1.62 |
| 2 | 0.38 - 0.40 | 1.42 - 1.45 |
| 3 | 0.45 | 1.51 |

What is claimed is:

1. A coaxial cable having improved mechanical and electrical properties comprising an inner conductor; an outer inert gas blown cellular ethylene or propylene polymer dielectric layer having in unexpanded form a density of about 0.86 to 0.96 grams per cubic centimeter, a melt index of about 0.05 to 10 decigrams per minute and an expanded density up to 0.6 grams per cubic centimeter, and dielectric layer having a dissipation factor value of ≤ 250 microradians at an electrical transmission frequency range of from 50 to 300 mega Hertz; and an outer coaxial conductor.

2. A coaxial cable as claimed in claim 1, having a dissipation factor value of ≤ 150 microradians at an electrical transmission frequency of 211 mega Hertz.

3. A coaxial cable as claimed in claim 1, having a dissipation factor value of ≤ 200 microradians at an electrical transmission frequency of 300 mega Hertz.

4. A coaxial cable as claimed in claim 1, wherein said ethylene or propylene polymer is a homopolymer.

5. A coaxial cable core member as claimed in claim 1, wherein said polymer of said dielectric layer contains, as the base polymer component, 98.0 to 99.98% by weight ethylene or propylene polymer, 0.1 to 1.0% by weight of nucleating agent and 0.01 to 1.0% by weight of antioxidant.

* * * * *